US010308395B2

(12) United States Patent
Zhang

(10) Patent No.: US 10,308,395 B2
(45) Date of Patent: Jun. 4, 2019

(54) PACKING BOX CAPABLE OF ADJUSTING ITS SIZE

(71) Applicant: Jie Zhang, Berwick (AU)

(72) Inventor: Jie Zhang, Berwick (AU)

( * ) Notice: Subject to any disclaimer, the term of this patent is extended or adjusted under 35 U.S.C. 154(b) by 49 days.

(21) Appl. No.: 15/176,171

(22) Filed: Jun. 8, 2016

(65) Prior Publication Data

US 2017/0073109 A1 Mar. 16, 2017

(30) Foreign Application Priority Data

Sep. 10, 2015 (CN) ..... 2015 2 0698260 U

(51) Int. Cl.
*B65D 21/08* (2006.01)
*B65D 5/355* (2006.01)

(52) U.S. Cl.
CPC ..... *B65D 21/086* (2013.01); *B65D 5/0005* (2013.01); *B65D 21/083* (2013.01)

(58) Field of Classification Search
CPC .... B65D 21/08; B65D 21/083; B65D 21/086; B65D 5/0005
USPC ..... 229/101; 220/8, 4.03
See application file for complete search history.

(56) References Cited

U.S. PATENT DOCUMENTS 4,101,052 A * 7/1978 Dove ..... B65D 5/0005 206/807
4,982,857 A * 1/1991 Sher ..... B65F 1/0046 220/4.03
5,016,772 A * 5/1991 Wilk ..... B65D 21/086 220/495.01
5,139,186 A * 8/1992 Loew ..... B60R 11/00 206/3
5,192,019 A * 3/1993 Meehan ..... B65D 5/0005 220/8
2002/0121520 A1* 9/2002 Govrik ..... B65D 1/36 220/500
2004/0040960 A1* 3/2004 Gledhill ..... B65D 21/0204 220/23.4
2011/0269367 A1* 11/2011 Byrd ..... B65D 21/086 446/76
2015/0041352 A1* 2/2015 Huang ..... B65D 85/48 206/454

* cited by examiner

*Primary Examiner* — Fenn C Mathew
*Assistant Examiner* — Jennifer Castriotta

(57) ABSTRACT

A packing box contains: an accommodation casing, a first side casing, a second side casing, multiple bottom casings of various sizes, multiple top casings of various sizes, and a plurality of binding straps. The accommodation casing includes multiple first and second spaced holes, the first side casing includes multiple first and second spaced orifices, and the second side casing includes multiple first and second spaced apertures. Each bottom casing covers a bottom of each of the accommodation casing, the first side casing, and the second side casing, and each top casing covers a top of each of the accommodation casing, the first side casing, and the second side casing. Each binding strap includes a fastener, a male fastening face, and a female fastening face, wherein the fastener fastens with the male fastening face and the female fastening face so that said each binding strap fixes the packing box.

4 Claims, 12 Drawing Sheets

PACKING BOX CAPABLE OF ADJUSTING ITS SIZE

CROSS-REFERENCE TO RELATED APPLICATIONS

This application claims priority to China Application No. 201520698260.0 filed Sep. 10, 2015.

FIELD OF THE INVENTION

The present invention relates to a packing box which is assembled in various sizes based on using requirements.

BACKGROUND OF THE INVENTION

A conventional packing box is adapted to package a product in a fixed size, but as packing another product of different size, another packing box corresponding to said another product of different size is required.

The present invention has arisen to mitigate and/or obviate the afore-described disadvantages.

SUMMARY OF THE INVENTION

The primary objective of the present invention is to provide a packing box which is assembled in various sizes based on using requirements.

To obtain above-mentioned objective, a packing box provided by a first embodiment of the present invention contains: an accommodation casing, a first side casing, a second side casing, multiple bottom casings of various sizes, multiple top casings of various sizes, and a plurality of binding straps.

The accommodation casing is formed in a U shape and includes a plurality of first spaced holes defined on two upper ends of two side surfaces thereof and a plurality of second spaced holes defined on two lower ends of the two side surfaces thereof.

The first side casing is formed in a U shape and is fitted onto a first end of the accommodation casing, and the first side casing includes multiple first spaced orifices formed on two upper ends of two side surfaces thereof and includes multiple second spaced orifices formed on two lower ends of the two side surfaces thereof, and when the first side casing moves away from or close to the accommodation casing, the multiple first spaced orifices align with some of the plurality of first spaced holes, and the multiple second spaced orifices align with some of the plurality of second spaced holes.

The second side casing is formed in a U shape and is fitted onto a second end of the accommodation casing, and the second side casing includes multiple first spaced apertures arranged on two upper ends of two side surfaces thereof and includes multiple second spaced apertures arranged on two lower ends of the two side surfaces thereof, and when the second side casing moves away from or close to the accommodation casing, the multiple first spaced apertures align with another of the plurality of first spaced holes, and the multiple second spaced apertures align with another of the plurality of second spaced holes.

Each bottom casing covers a bottom of each of the accommodation casing, the first side casing, and the second side casing, wherein a size of said each bottom casing corresponds to a length of a combination of bottoms of the accommodation casing, the first side casing, and the second side casing.

Each top casing covers a top of each of the accommodation casing, the first side casing, and the second side casing, wherein a size of said each top casing corresponds to a length of a combination of tops of the accommodation casing, the first side casing, and the second side casing.

Each binding strap inserts into the packing box from each first spaced orifice or each first spaced aperture via each first spaced hole, and said each binding strap extends out of a packing box from each second spaced hole through each second spaced orifice or each second spaced aperture, thereafter said each binding strap surrounds said each bottom casing and inserts into the packing box from said each second spaced orifice or said each second spaced aperture via said each second spaced hole, and said each binding strap extends outwardly from said each first spaced hole through said each first spaced orifice or each first spaced aperture so as to surround said each top casing.

Said each biding strap includes a fastener arranged on a first end thereof, a male fastening face formed on a top of a second end thereof, and a female fastening face arranged on a bottom of the second end thereof, wherein the fastener fastens with the male fastening face and the female fastening face so that said each binding strap fixes the packing box.

DETAILED DESCRIPTION OF THE PREFERRED EMBODIMENTS

Figure 1:
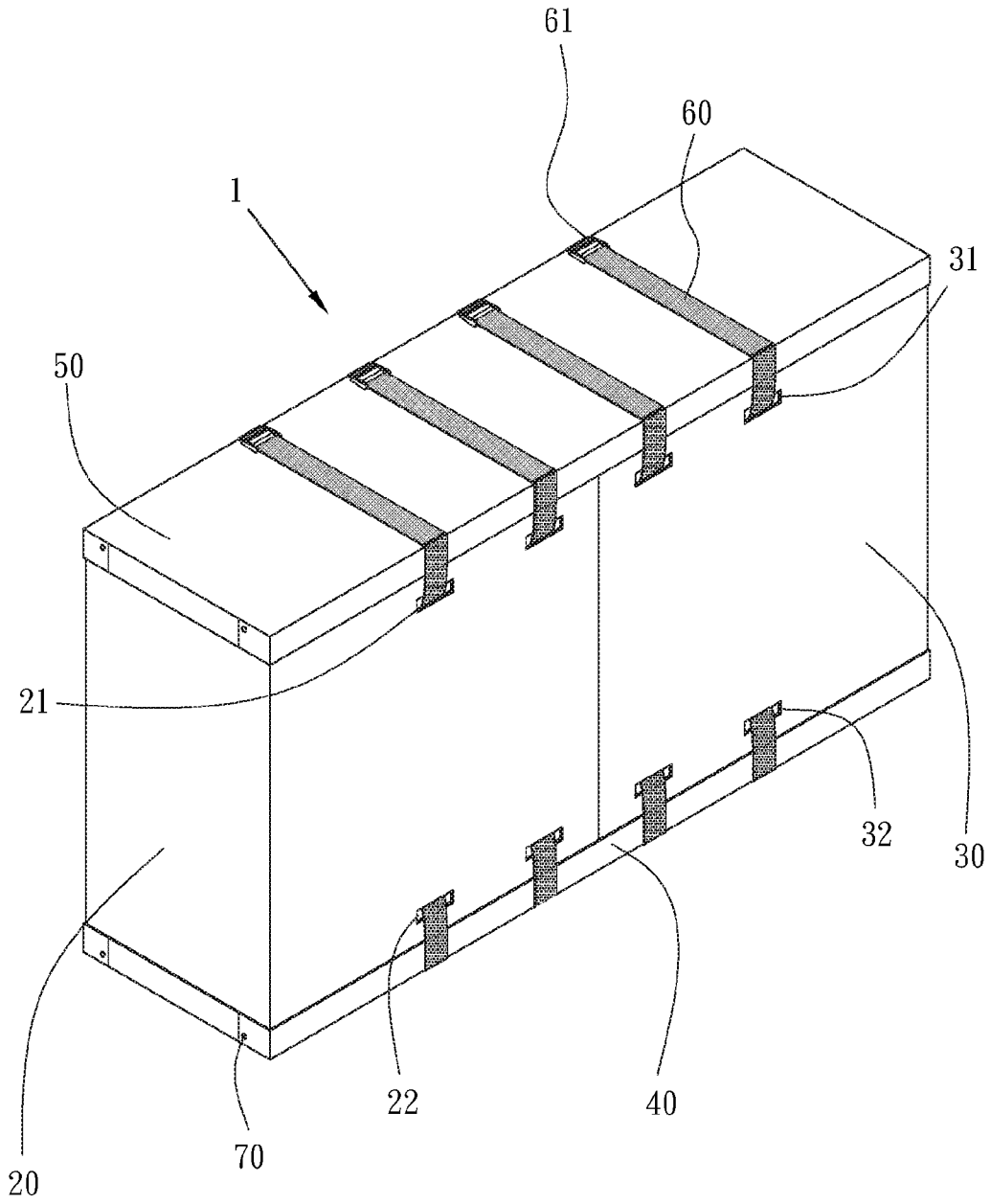
FIG. 1 is a perspective view showing the assembly of a packing box according to a first embodiment of the present invention.

With reference to FIGS. 1 to 5, a packing box 1 according to a first embodiment of the present invention comprises: an accommodation casing 10, a first side casing 20, a second side casing 30, multiple bottom casings 40 of various sizes, multiple top casings 50 of various sizes, and a plurality of binding straps 60.

The accommodation casing 10 is formed in a U shape and includes a plurality of first spaced holes 11 defined on two upper ends of two side surfaces thereof and a plurality of second spaced holes 12 defined on two lower ends of the two side surfaces thereof.

The first side casing 20 is formed in a U shape and is fitted onto a first end of the accommodation casing 10, wherein the first side casing 20 includes multiple first spaced orifices 21 formed on two upper ends of two side surfaces thereof and includes multiple second spaced orifices 22 formed on two lower ends of the two side surfaces thereof, and when the first side casing 20 moves away from or close to the accommodation casing 10, the multiple first spaced orifices 21 align with some of the plurality of first spaced holes 11, and the multiple second spaced orifices 22 align with some of the plurality of second spaced holes 12.

The second side casing 30 is formed in a U shape and is fitted onto a second end of the accommodation casing 10, wherein the second side casing 30 includes multiple first spaced apertures 31 arranged on two upper ends of two side surfaces thereof and includes multiple second spaced apertures 32 arranged on two lower ends of the two side surfaces thereof, and when the second side casing 30 moves away from or close to the accommodation casing 10, the multiple first spaced apertures 31 align with another of the plurality of first spaced holes 11, and the multiple second spaced apertures 32 align with another of the plurality of second spaced holes 12.

Each of the multiple bottom casings 40 is in a rectangle shape and covers a bottom of each of the accommodation casing 10, the first side casing 20, and the second side casing 30, wherein a size of said each bottom casing 40 corresponds to a length of a combination of bottoms of the accommodation casing 10, the first side casing 20, and the second side casing 30.

Each of the multiple top casings 50 is in a rectangle shape and covers a top of each of the accommodation casing 10, the first side casing 20, and the second side casing 30, wherein a size of said each top casing 50 corresponds to a length of a combination of tops of the accommodation casing 10, the first side casing 20, and the second side casing 30.

Each of the plurality of binding straps 60 is inserted into the packing box 1 from one of the multiple first spaced orifices 21 or one of the multiple first spaced apertures 31 via one of the plurality of first spaced holes 11, and said each binding strap 60 extends out of the packing box 1 from one of the plurality of second spaced holes 12 through one of the multiple second spaced orifices 22 or one of the multiple second spaced apertures 33, thereafter each binding strap 60 surrounds one of the bottom casings 40 and is inserted into the packing box 1 from one of the second spaced orifices 22 or one of the second spaced apertures 33 via one of the second spaced hole 12, and said each binding strap 60 extends outwardly from one of the first spaced holes 11 through one of the first spaced orifices 21 or one of the first spaced apertures 31 so as to surround one of the top casings 50. Said each binding strap 60 includes a loop 61 arranged on a first end thereof, a second end of the binding strap 60 is provided with a hook-and-loop fastener consisting of a male fastening face 621 and a female fastening face 622. The second end of the binding strap 60 is passed through the loop 61 and turned around to make the male fastening face 621 fasten with the female fastening face 622 so that each binding strap 60 binds the packing box 1 tightly.

Figure 5A:
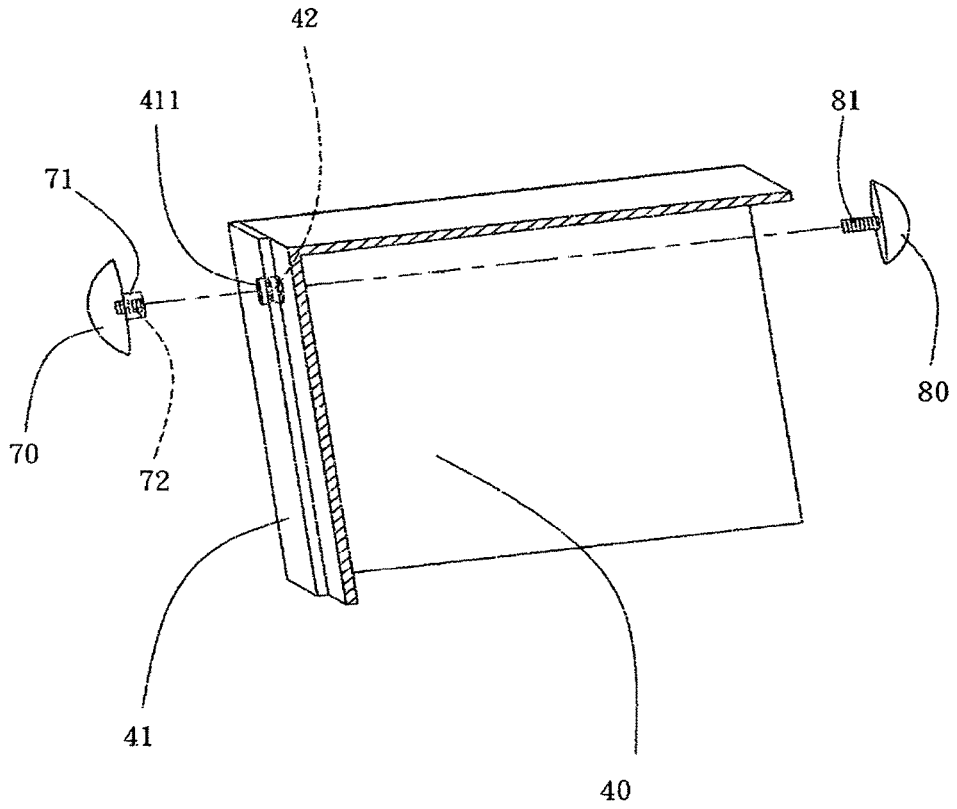
FIGS. 5*a* and 5*b* are perspective views showing the exploded components of a part of the packing box according to the first embodiment of the present invention.
Figure 5B:
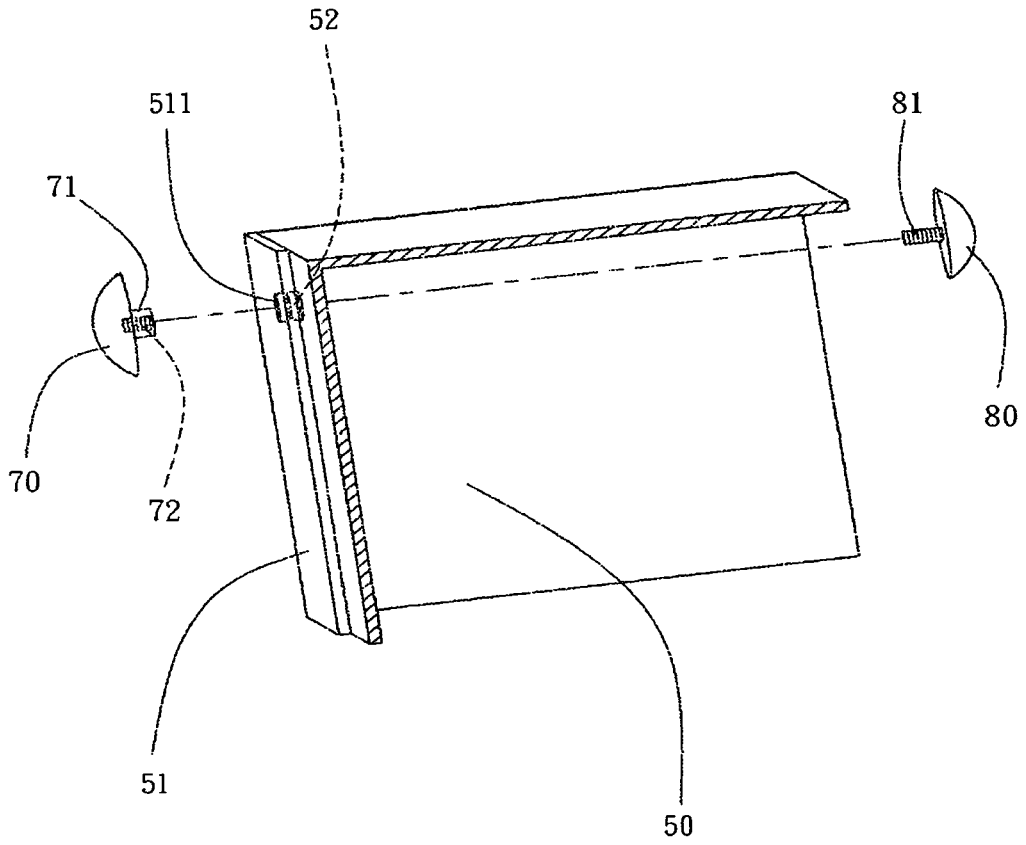

Referring to FIGS. 5*a* and 5*b*, each of said bottom casings 40 includes multiple bottom extending fringes 41, and each bottom extending fringe 41 has a first bottom opening 411 defined thereon. Each of said top casings 50 includes multiple top extending fringes 51, and each top extending fringe 51 has a first top opening 511 defined thereon. Each bottom casing 40 further includes multiple second bottom openings 42, and each of the multiple second bottom openings 42 corresponds to the first bottom opening 411 of each of said bottom extending fringes 41. Each top casing 50 further includes multiple second top openings 52, and each of the multiple second top openings 52 corresponds to the first top opening 511 of each of said top extending fringes 51.

The packing box 1 further comprises multiple first fixing elements 70, and each of the multiple first fixing elements 70 is configured to fix each of said bottom extending fringes 41 and has a hollow extension 71 which extends through either one of the first bottom openings 411 and a corresponding one of said second bottom openings 42 or one of the first top openings and a corresponding one of said second top openings 52.

The packing box 1 further comprises multiple second fixing elements 80, and each of the multiple second fixing elements 80 is inserted through each of said second bottom openings 42 and each of said second top openings 52. Each of said second fixing elements 80 includes outer threads 81 formed thereon, and each of said first fixing elements 70 includes inner threads 72 arranged in the hollow extension 71, such that the outer threads 81 of each of said second fixing elements 80 screw with the inner threads 72 of a corresponding one of said fixing elements 80, thus fixing one of the bottom casings 40 and each bottom extending fringe 41 together or fixing one of the top casings 50 and each top extending fringe 51 together.

Figure 2:
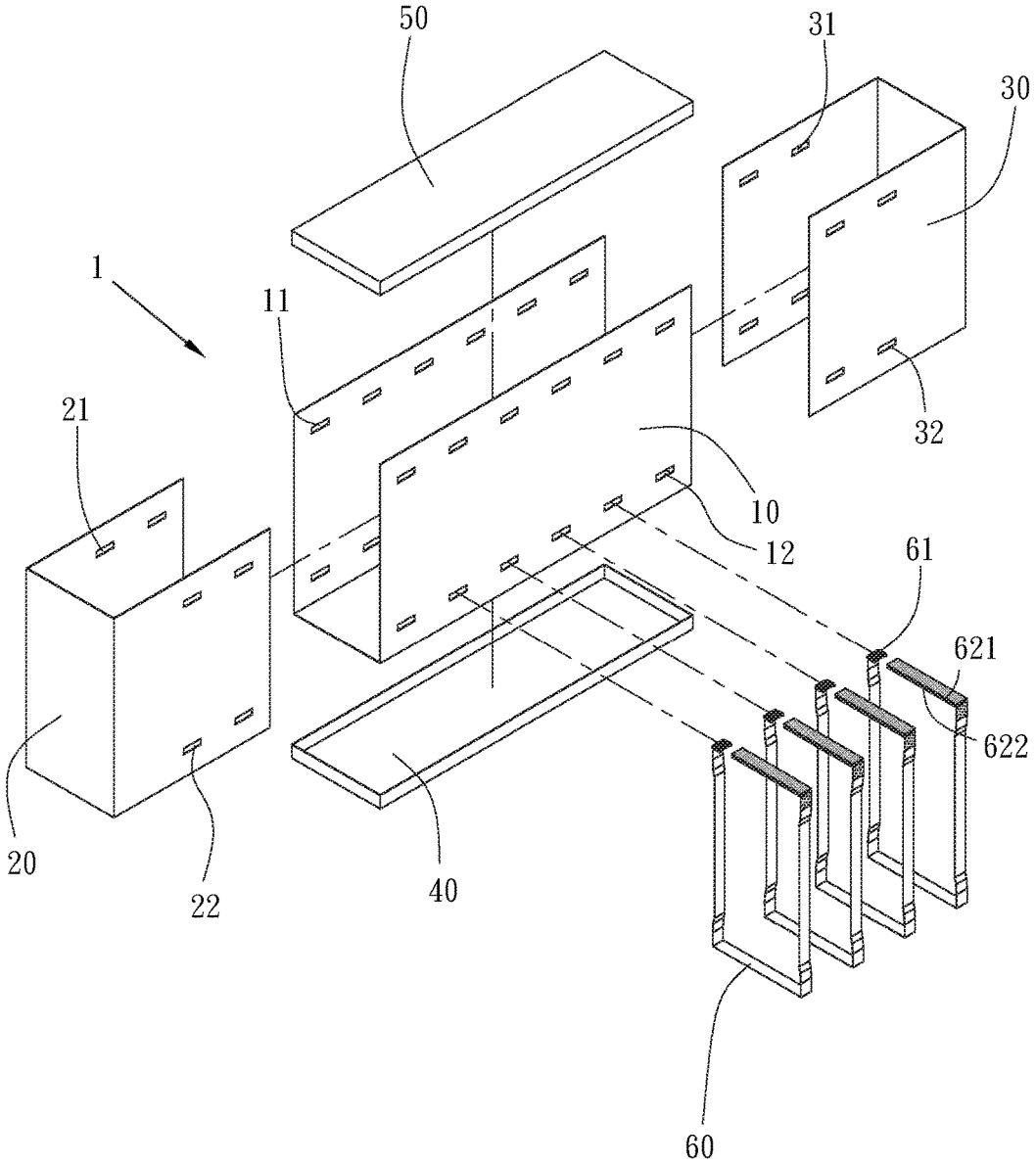
FIG. 2 is a perspective view showing the exploded components of the packing box according to the first embodiment of the present invention.

As shown in FIGS. 1 to 2, as packing a product by using a packing box 1 of a small size, the first side casing 20 and the second side casing 30 are fitted onto the accommodation casing 10, wherein the first side casing 20 and the second side casing 30 are connected together, and a bottom casing 40 of a small size and a top casing 50 of a small size cover the accommodation casing 10, the first side casing 20, and the second side casing 30. Thereafter, the plurality of binding straps 60 surround the packing body 1 and insert through the plurality of first and second spaced holes 11, 12, the multiple first spaced orifices 21, the multiple first spaced apertures 31, the multiple second spaced orifices 22, and the multiple second spaced apertures 32, thus connecting the accommodation casing 10, the first side casing 20, the second side casing 30, the bottom casing 40, and the top casing 50 together to produce the packing box 1 of the small size.

Figure 3:
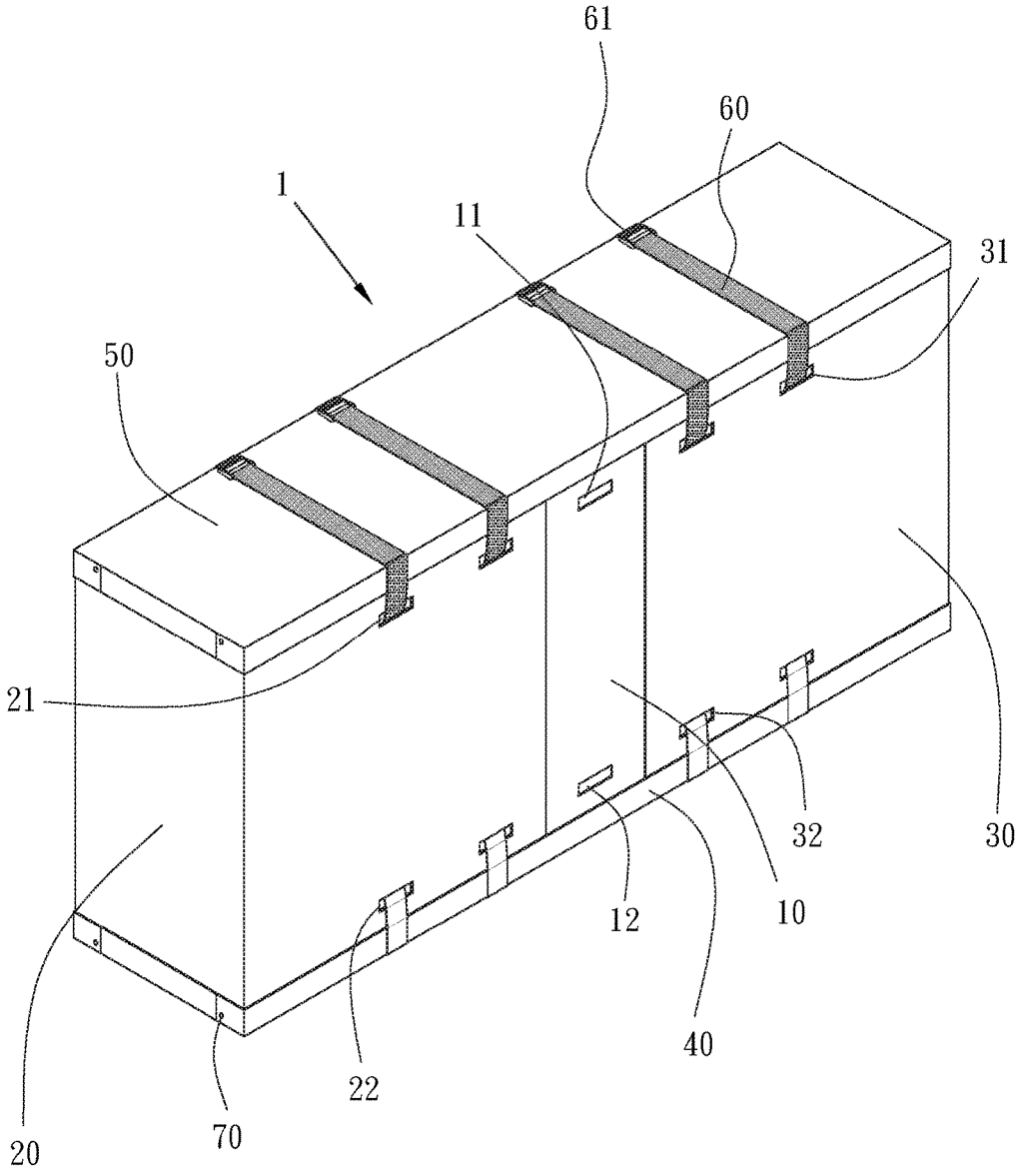
FIG. 3 is a perspective view showing the assembly of a packing box according to a second embodiment of the present invention.

As illustrated in FIG. 3, in a second embodiment, as packing another product by using a packing box 1 of a medium size, the first side casing 20 and the second side casing 30 are fitted onto the accommodation casing 10, wherein between the first side casing 20 and the second side casing 30 is defined a small distance at which at least one first and second spaced holes 11, 12 expose, and a bottom casing 40 of a medium size and a top casing 50 of a medium size cover the accommodation casing 10, the first side casing 20, and the second side casing 30. Thereafter, the plurality of binding straps 60 surround the packing body 1 and insert through the plurality of first and second spaced holes 11, 12, the multiple first spaced orifices 21, the multiple first spaced apertures 31, the multiple second spaced orifices 22, and the multiple second spaced apertures 32, thus connecting the accommodation casing 10, the first side casing 20, the second side casing 30, the bottom casing 40, and the top casing 50 together to produce the packing box 1 of the medium size.

Figure 4:
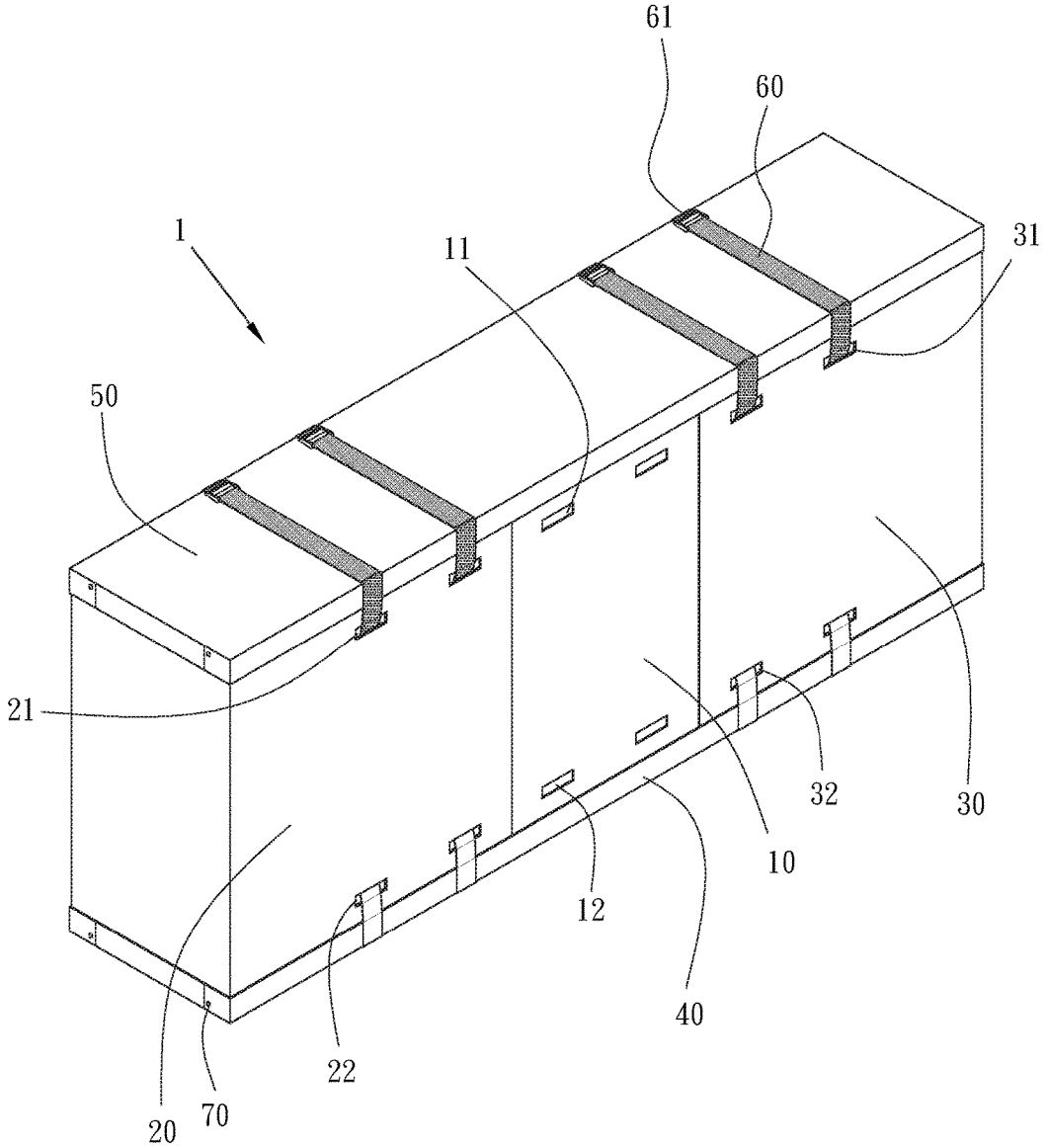
FIG. 4 is a perspective view showing the assembly of a packing box according to a third embodiment of the present invention.

With reference to FIG. 4, in a third embodiment, as packing another product by using a packing box 1 of a large size, the first side casing 20 and the second side casing 30 are fitted onto the accommodation casing 10, wherein between the first side casing 20 and the second side casing 30 is defined a large distance at which at least two first and second spaced holes 11, 12 expose, and a bottom casing 40 of a large size and a top casing 50 of a large size cover the accommodation casing 10, the first side casing 20, and the second side casing 30. Thereafter, the plurality of binding straps 60 surround the packing body 1 and insert through the plurality of first and second spaced holes 11, 12, the multiple first spaced orifices 21, the multiple first spaced apertures 31, the multiple second spaced orifices 22, and the multiple second spaced apertures 32, thus connecting the accommodation casing 10, the first side casing 20, the second side casing 30, the bottom casing 40, and the top casing 50 together to produce the packing box 1 of the large size.

Accordingly, the packing box of the present intention is assembled in the various sizes based on using requirements.

Figure 6:
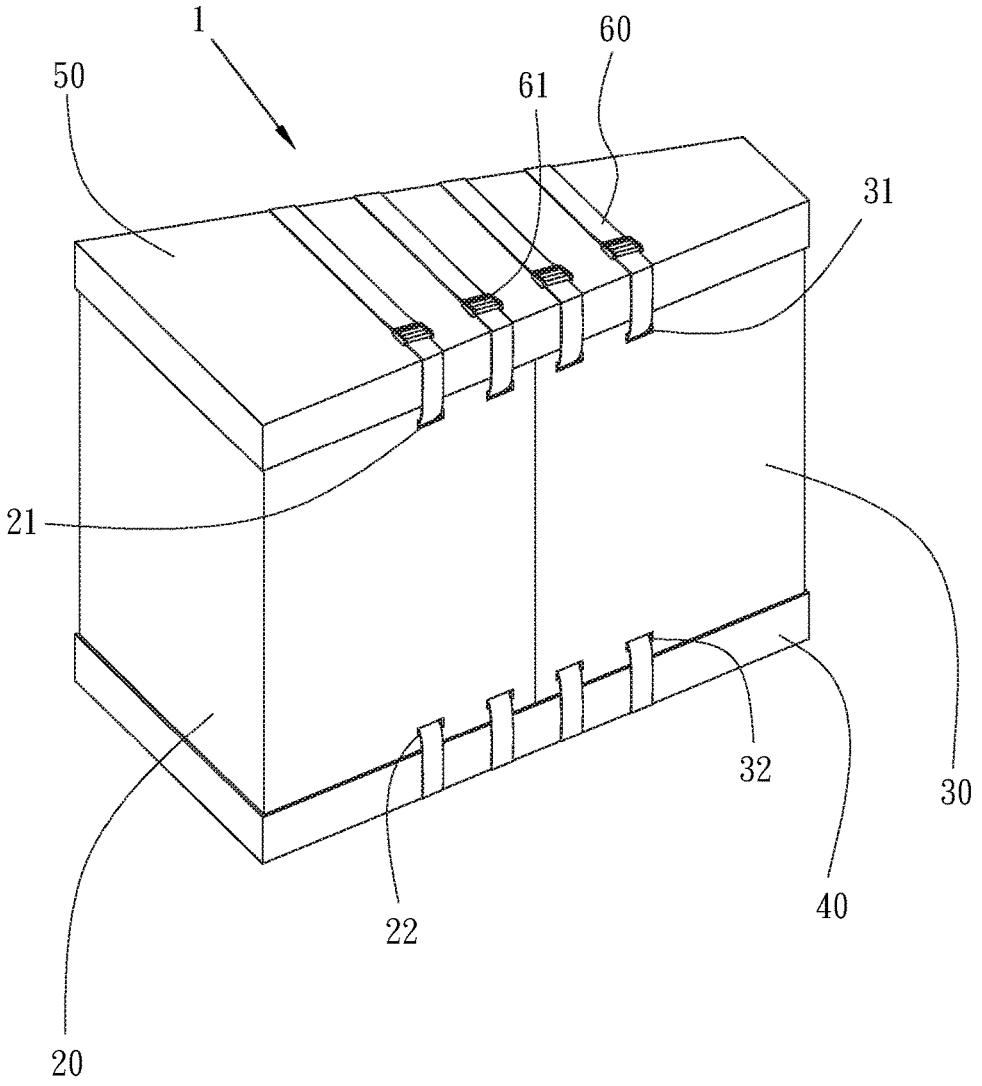
FIG. 6 is a perspective view showing the assembly of a packing box according to a fourth embodiment of the present invention.
Figure 7:
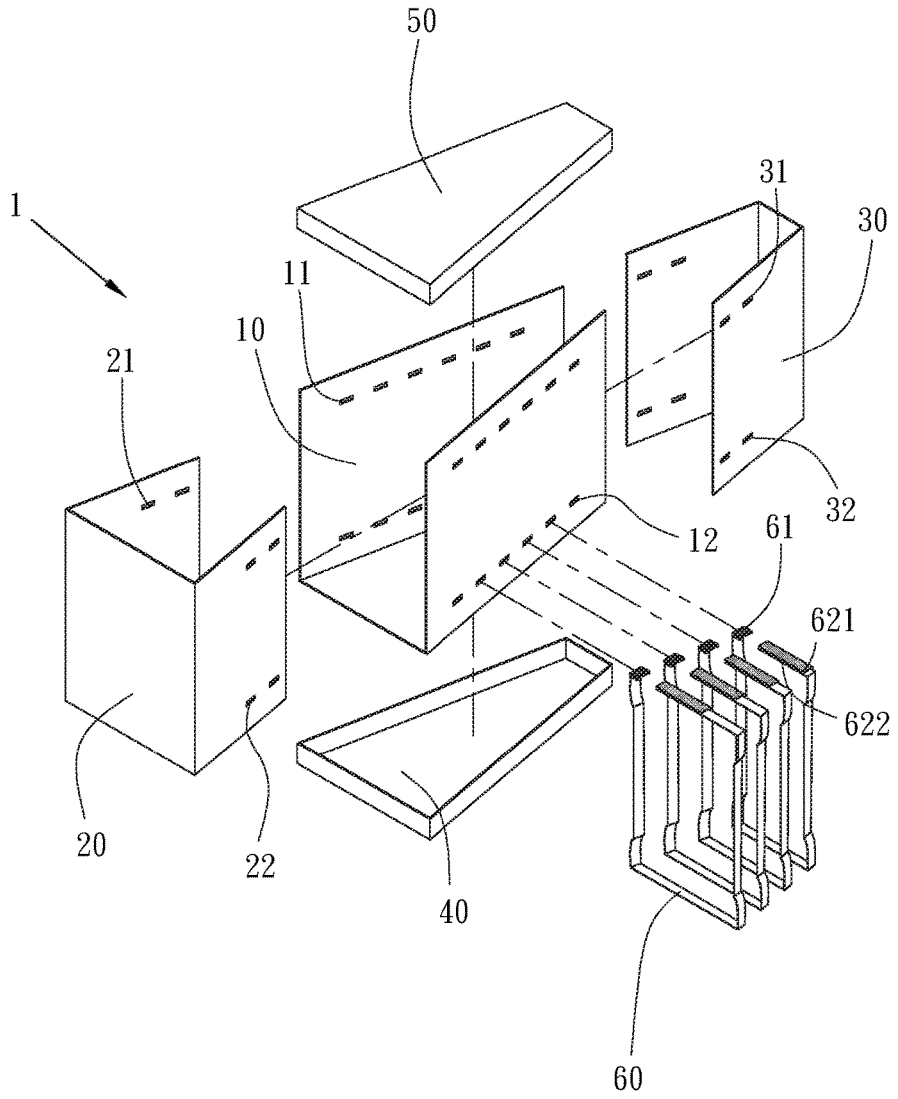
FIG. 7 is a perspective view showing the exploded components of the packing box according to the fourth embodiment of the present invention.
Figure 8:
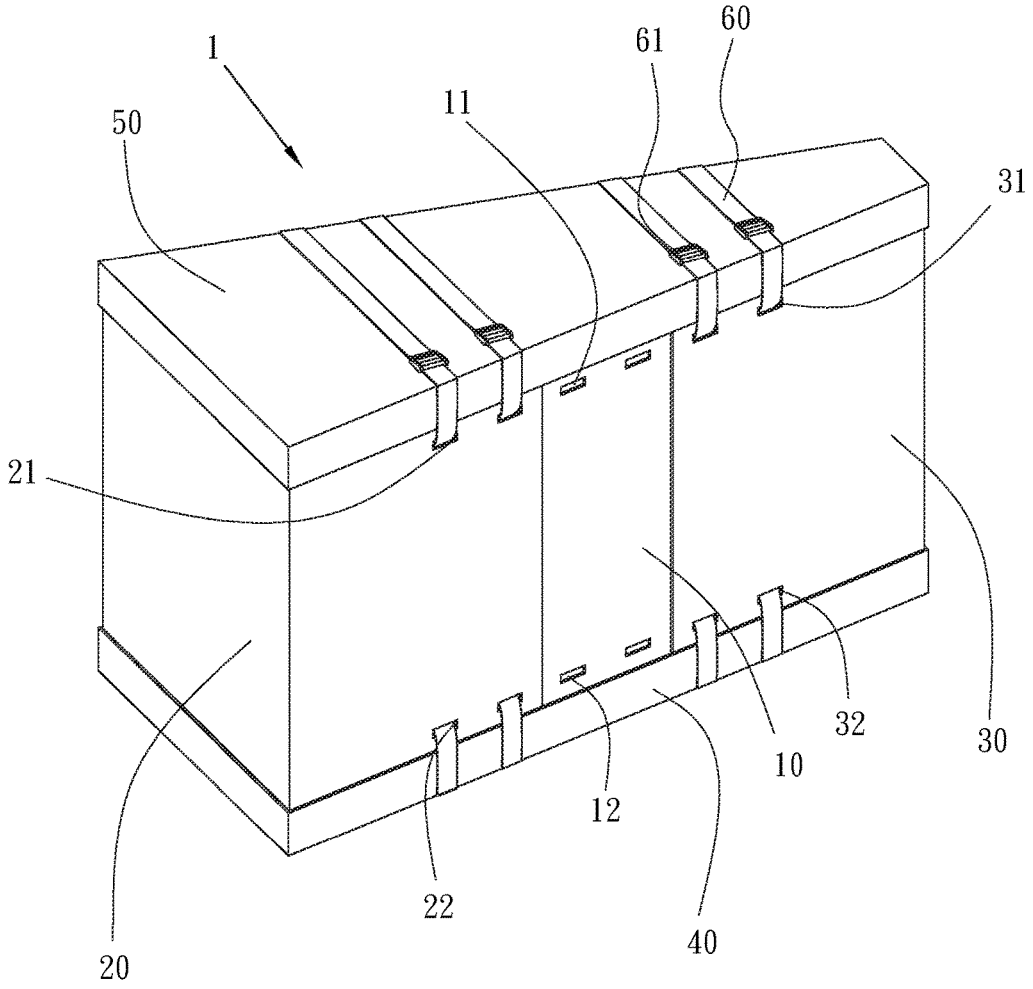
FIG. 8 is a perspective view showing the operation of the packing box according to the fourth embodiment of the present invention.

With reference to FIGS. 6 to 8, a packing box 1 according to a fourth embodiment of the present invention comprises: an accommodation casing 10, a first side casing 20, a second side casing 30, multiple bottom casings 40 of various sizes, multiple top casings 50 of various sizes, and a plurality of binding straps 60.

The accommodation casing 10 is formed in a triangle shape and includes a plurality of first spaced holes 11 defined on two upper ends of two side surfaces thereof and a plurality of second spaced holes 12 defined on two lower ends of the two side surfaces thereof.

The first side casing 20 is formed in a U shape and is fitted onto a first end of the accommodation casing 10, wherein the first side casing 20 includes multiple first spaced orifices 21 formed on two upper ends of two side surfaces thereof and includes multiple second spaced orifices 22 formed on two lower ends of the two side surfaces thereof, and when the first side casing 20 moves away from or close to the accommodation casing 10, the multiple first spaced orifices 21 align with some of the plurality of first spaced holes 11, and the multiple second spaced orifices 22 align with some of the plurality of second spaced holes 12.

The second side casing 30 is formed in a U shape and is fitted onto a second end of the accommodation casing 10, wherein the second side casing 30 includes multiple first spaced apertures 31 arranged on two upper ends of two side surfaces thereof and includes multiple second spaced apertures 32 arranged on two lower ends of the two side surfaces thereof, and when the second side casing 30 moves away from or close to the accommodation casing 10, the multiple first spaced apertures 31 align with another of the plurality of first spaced holes 11, and the multiple second spaced apertures 32 align with another of the plurality of second spaced holes 12.

Each of the multiple bottom casings 40 is in a triangle shape and covers a bottom of each of the accommodation casing 10, the first side casing 20, and the second side casing 30, wherein a size of said each bottom casing 40 corresponds to a length of a combination of bottoms of the accommodation casing 10, the first side casing 20, and the second side casing 30.

Each of the multiple top casings 50 is in a triangle shape and covers a top of each of the accommodation casing 10, the first side casing 20, and the second side casing 30, wherein a size of said each top casing 50 corresponds to a length of a combination of tops of the accommodation casing 10, the first side casing 20, and the second side casing 30.

Each of the plurality of binding straps 60 inserts into the packing box 1 from each of the multiple first spaced orifices 21 or each of the multiple first spaced apertures 31 via each of the plurality of first spaced holes 11, and said each binding strap 60 extends out of each of the plurality of second spaced holes 12 of the packing box 1 through each of the multiple second spaced orifices 22 or each of the multiple second spaced apertures 33, thereafter said each binding strap 60 surrounds said each bottom casing 40 and inserts into the packing box 1 from said each second spaced orifice 22 or said each second spaced aperture 33 via said each second spaced hole 12, and said each binding strap 60 extends outwardly from said each first spaced hole 11 through said each first spaced orifice 21 or each first spaced aperture 31 so as to surround said each top casing 50. Said each biding strap 60 includes a fastener 61 arranged on a first end thereof, a male fastening face 621 formed on a top of a second end thereof, and a female fastening face 622 arranged on a bottom of the second end thereof, wherein the fastener 61 fastens with the male fastening face 621 and the female fastening face 622 so that said each binding strap 60 fixes the packing box 1.

Figure 9:
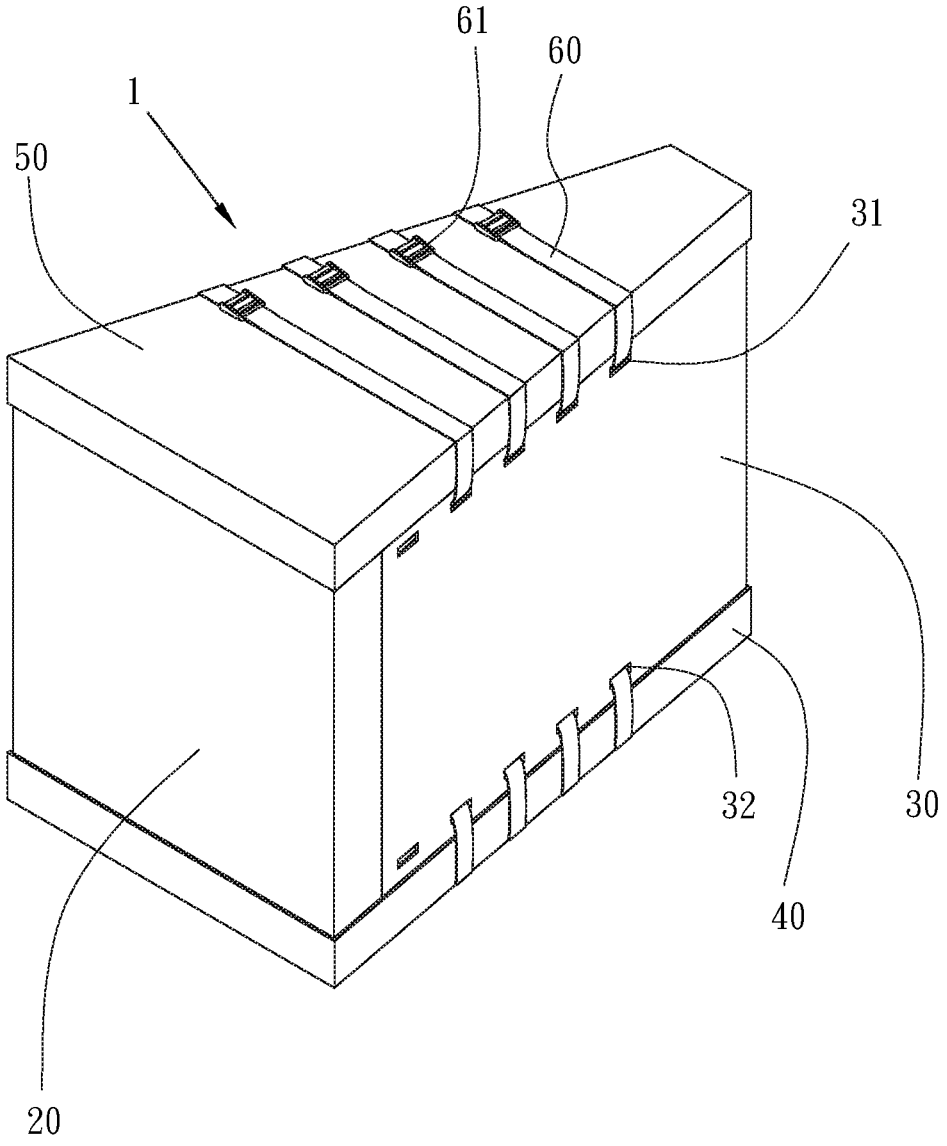
FIG. 9 is a perspective view showing the assembly of a packing box according to a fifth embodiment of the present invention.
Figure 10:
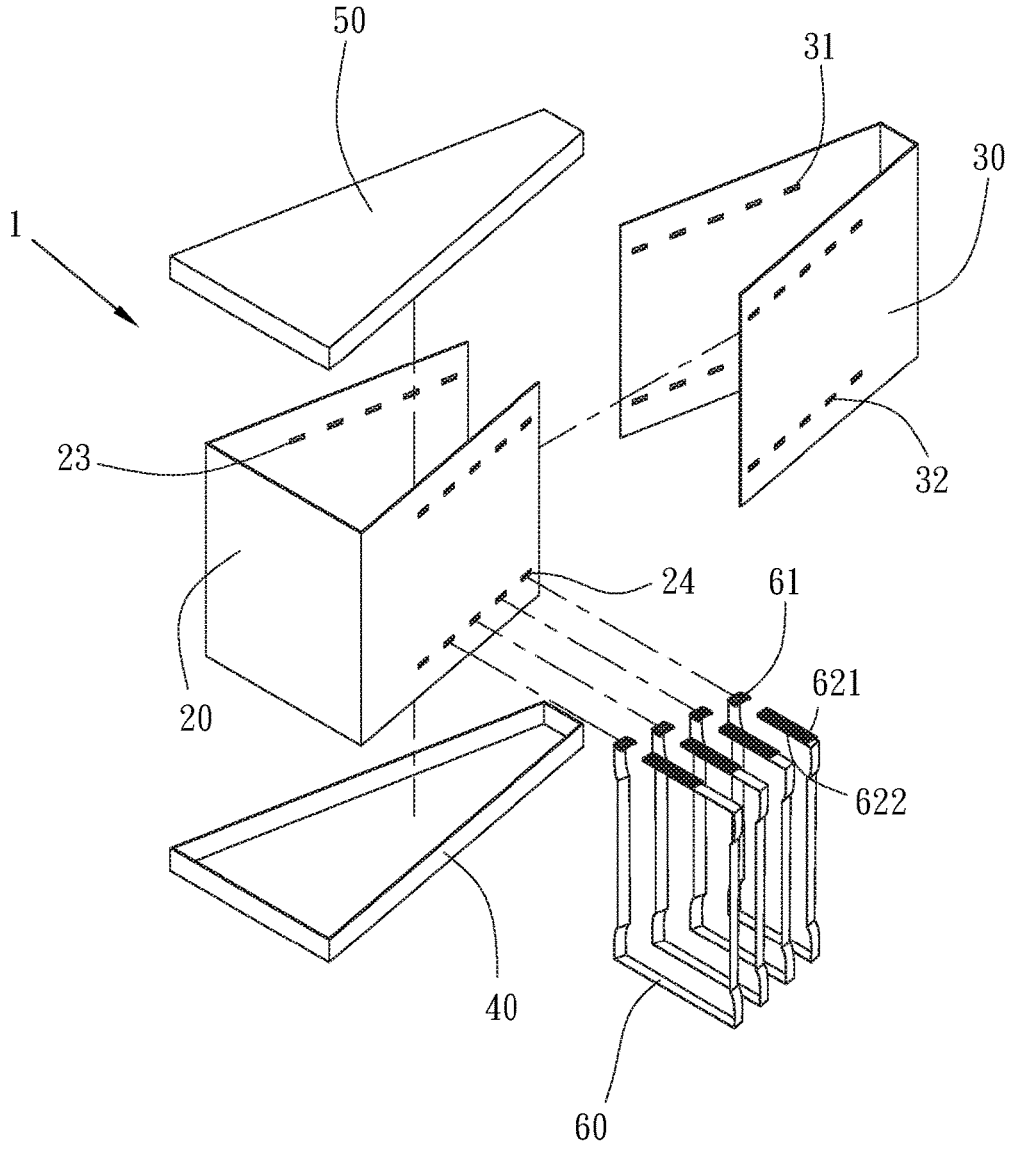
FIG. 10 is a perspective view showing the exploded components of the packing box according to the fifth embodiment of the present invention.
Figure 11:
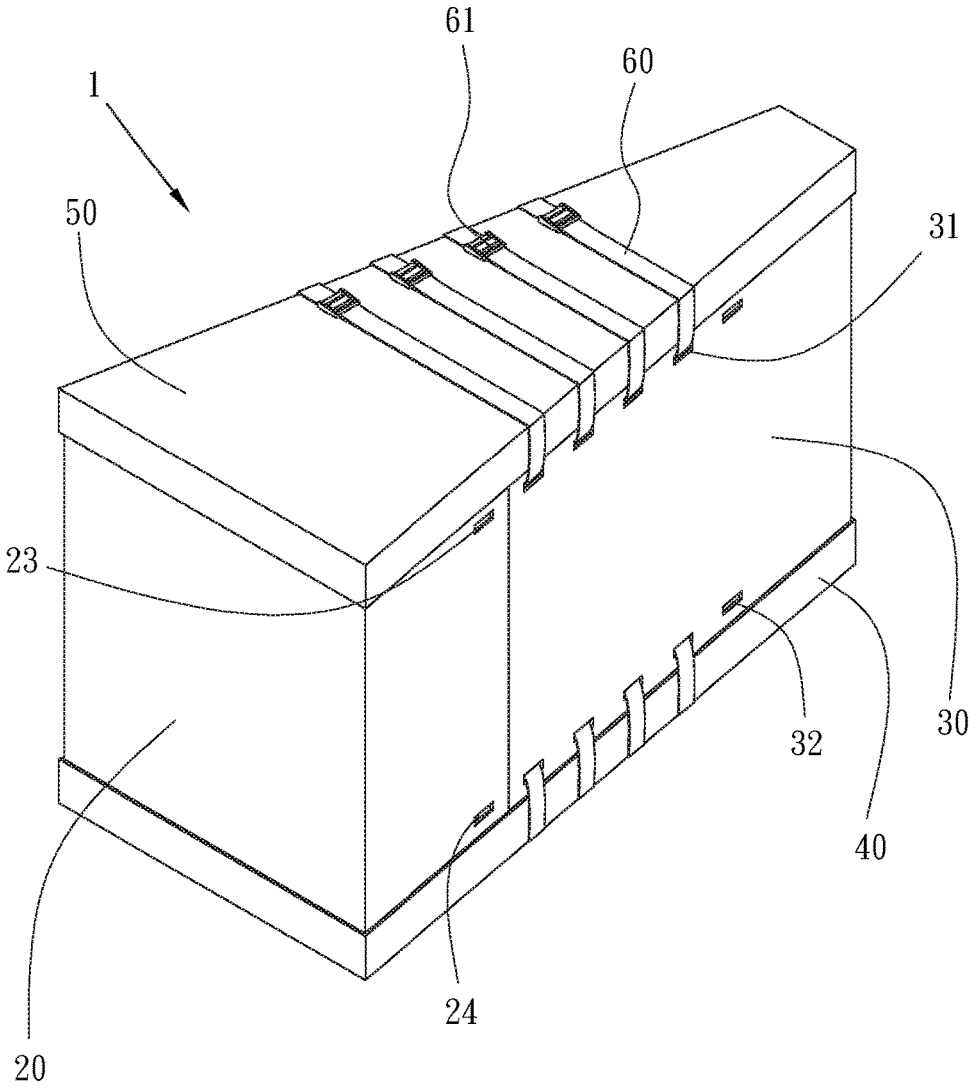
FIG. 11 is a perspective view showing the operation of the packing box according to the fifth embodiment of the present invention.

With reference to FIGS. 9 to 11, a packing box 1 according to a fifth embodiment of the present invention comprises: a first side casing 20, a second side casing 30, multiple bottom casings 40 of various sizes, multiple top casings 50 of various sizes, and a plurality of binding straps 60.

The first side casing 20 is formed in a U shape, and the first side casing 20 includes multiple first spaced orifices 23 formed on two upper ends of two side surfaces thereof and includes multiple second spaced orifices 24 formed on two lower ends of the two side surfaces thereof.

The second side casing 30 is formed in a U shape and is fitted with the first side casing 20, wherein the second side casing 30 includes multiple first spaced apertures 31 arranged on two upper ends of two side surfaces thereof and corresponding to the multiple first spaced orifices 23, and the second side casing 30 includes multiple second spaced apertures 32 arranged on two lower ends of the two side surfaces thereof and corresponding to the multiple second spaced orifices 24, and when the second side casing 30 moves away from or close to the first side casing 40, the multiple first spaced apertures 31 align with the multiple first spaced orifices 23, and the multiple second spaced apertures 32 align with another of the multiple second spaced orifices 24.

Each of the multiple bottom casings 40 is in a triangle shape and covers a bottom of each of the first side casing 20 and the second side casing 30, wherein a size of said each bottom casing 40 corresponds to a length of a combination of bottoms of the first side casing 20 and the second side casing 30.

Each of the multiple top casings 50 is in a triangle shape and covers a top of each of the first side casing 20 and the second side casing 30, wherein a size of said each top casing 50 corresponds to a length of a combination of tops of the first side casing 20 and the second side casing 30.

Each of the plurality of binding straps 60 inserts into the packing box 1 via each of the multiple first spaced apertures 31 and each of the multiple first spaced orifices 23, and said each binding strap 60 extends out of the packing box 1 through each of the multiple second spaced orifices 24 and each of the multiple second spaced apertures 32, thereafter said each binding strap 60 surrounds said each bottom casing 40 and inserts into the packing box 1 via said each second spaced orifice 24 and said each second spaced aperture 32, and said each binding strap 60 extends outwardly from said each first spaced orifice 23 through said each first spaced aperture 31 so as to surround said each top casing 50. Said each biding strap 60 includes a fastener 61 arranged on a first end thereof, a male fastening face 621 formed on a top of a second end thereof, and a female fastening face 622 arranged on a bottom of the second end thereof, wherein the fastener 61 fastens with the male fastening face 621 and the female fastening face 622 so that said each binding strap 60 fixes the packing box 1.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A packing box comprising: an accommodation casing, a first side casing, a second side casing, multiple bottom casings of various sizes, multiple top casings of various sizes, and a plurality of binding straps; wherein the accommodation casing is formed in a U shape with two side surfaces and includes a plurality of first spaced holes defined on an upper end of each of the two side surfaces thereof and includes a plurality of second spaced holes defined on a lower end of each of the two side surfaces thereof;

the first side casing is formed in a U shape with two side surfaces and is fitted onto a first end of the accommodation casing, and the first side casing includes multiple first spaced orifices formed on a first end of each of the two side surfaces thereof, the first side casing also includes multiple second spaced orifices formed on a second end of each of the two side surfaces thereof, wherein when the first side casing moves away from or close to the accommodation casing, the multiple first spaced orifices align with some of the plurality of first spaced holes, and the multiple second spaced orifices align with some of the plurality of second spaced holes;

the second side casing is formed in a U shape with two side surfaces and is fitted onto a second end of the accommodation casing, and the second side casing includes multiple first spaced apertures arranged on a first end of each of the two side surfaces thereof, the second side casing also includes multiple second spaced apertures arranged on a second end of each of the two side surfaces thereof, wherein when the second side casing moves away from or close to the accommodation casing, the multiple first spaced apertures align with another of the plurality of first spaced holes, and the multiple second spaced apertures align with another of the plurality of second spaced holes;

each of the multiple bottom casings covers a bottom of each of the accommodation casing, the first side casing, and the second side casing, wherein a size of each of said bottom casings corresponds to a length of a combination of bottoms of the accommodation casing, the first side casing, and the second side casing;

each of the multiple top casings covers a top of each of the accommodation casing, the first side casing, and the second side casing, wherein a size of each of said top casings corresponds to a length of a combination of tops of the accommodation casing, the first side casing, and the second side casing; and each of the plurality of binding straps is inserted into the packing box from one of the multiple first spaced orifices or one of the multiple first spaced apertures via one of the plurality of first spaced holes, and each of said binding straps extends out of the packing box from one of the plurality of second spaced holes through one of the multiple second spaced orifices or one of the multiple second spaced apertures, thereafter each of said binding straps surrounds one of said bottom casings and is inserted into the packing box from one of said second spaced orifices or one of said second spaced apertures via one of said second spaced holes, and each of said binding straps extends outwardly from one of said first spaced holes through one of said first spaced orifices or one of said first spaced apertures so as to surround one of said top casings;

wherein each of said binding straps includes a loop arranged on a first end thereof, a second end of the binding strap is provided with a hook-and-loop fastener consisting of a male fastening face and a female fastening face, the second end of the binding strap is passed through the loop and turned around to make the male fastening face fasten with the female fastening face so that each of said binding straps fixes the packing box.

2. The packing box as claimed in claim 1, wherein each of said top casings includes multiple top extending fringes, each of the multiple top extending fringes has a first top opening defined thereon, each of said top casings further includes multiple second top openings, and each of the multiple second top openings corresponds to a respective first top opening of each of said top extending fringes; wherein each of said bottom casings includes multiple bottom extending fringes, and each of the multiple bottom extending fringes has a first bottom opening defined thereon, each of said bottom casings further includes multiple second bottom openings, and each of the multiple second bottom openings corresponds to a respective first bottom opening of each of said bottom extending fringes;

the packing box further comprises multiple first fixing elements, and each of the multiple first fixing elements is configured to fix each of said bottom extending fringes and has a hollow extension which extends through either one of the first bottom openings and a corresponding one of said second bottom openings or one of the first top openings and a corresponding one of said second top openings; and the packing box further comprises multiple second fixing elements, and each of the multiple second fixing elements is inserted through a separate respective one of said second bottom openings and a corresponding one of said second top openings; each of said second fixing elements includes outer threads formed thereon, and each of said first fixing elements includes inner threads arranged in the hollow extension, such that the outer threads of each of said second fixing elements screw with the inner threads of a corresponding one of said first fixing elements.

3. A packing box comprising: an accommodation casing, a first side casing, a second side casing, multiple bottom casings of various sizes, multiple top casings of various sizes, and a plurality of binding straps; wherein the accommodation casing is formed in a triangle shape with two side surfaces and includes a plurality of first spaced holes defined on an upper end of each of two side surfaces thereof and includes a plurality of second spaced holes defined on a lower end of each of the two side surfaces thereof;

the first side casing is formed in a U shape with two side surfaces and is fitted onto a first end of the accommodation casing, and the first side casing includes multiple first spaced orifices formed on a first end of each of the two side surfaces thereof, the first side casing also includes multiple second spaced orifices formed on a second end of each of the two side surfaces thereof, wherein when the first side casing moves away from or close to the accommodation casing, the multiple first spaced orifices align with some of the plurality of first spaced holes, and the multiple second spaced orifices align with some of the plurality of second spaced holes;

the second side casing is formed in a U shape with two side surfaces and is fitted onto a second end of the accommodation casing, and the second side casing includes multiple first spaced apertures arranged on a first end of each of the two side surfaces thereof, the second side casing also includes multiple second spaced apertures arranged on a second end of each of the two side surfaces thereof, wherein when the second side casing moves away from or close to the accommodation casing, the multiple first spaced apertures align with another of the plurality of first spaced holes, and the multiple second spaced apertures align with another of the plurality of second spaced holes;

each of the multiple bottom casings is in a triangle shape and covers a bottom of each of the accommodation casing, the first side casing, and the second side casing, wherein a size of each of said bottom casings corresponds to a length of a combination of bottoms of the accommodation casing, the first side casing, and the second side casing;

each of the multiple top casings is in a triangle shape and covers a top of each of the accommodation casing, the first side casing, and the second side casing, wherein a size of each of said top casings corresponds to a length of a combination of tops of the accommodation casing, the first side casing, and the second side casing; and each of the plurality of binding straps is inserted into the packing box from one of the multiple first spaced orifices or one of the multiple first spaced apertures via one of the plurality of first spaced holes, and each of said binding straps extends out of one of the plurality of second spaced holes of the packing box through one of the multiple second spaced orifices or one of the multiple second spaced apertures, thereafter each of said binding straps surrounds one said bottom casings and is inserted into the packing box from one of said second spaced orifices or one of said second spaced apertures via one of said second spaced holes, and each of said binding straps extends outwardly from one of said first spaced holes through one of said first spaced orifices or one of said first spaced apertures so as to surround one of said top casings;

wherein each of said binding straps includes a loop arranged on a first end thereof, a second end of the binding strap is provided with a hook-and-loop fastener consisting of a male fastening face and a female fastening face, the second end of the binding strap is passed through the loop and turned around to make the male fastening face fasten with the female fastening face so that each of said binding straps fixes the packing box.

4. A packing box comprising: a first side casing, a second side casing, multiple bottom casings of various sizes, multiple top casings of various sizes, and a plurality of binding straps; wherein the first side casing is formed in a U shape with two side surfaces, and the first side casing includes multiple first spaced orifices formed on a first end of each of the two side surfaces thereof and includes multiple second spaced orifices formed on a second end of each of the two side surfaces thereof;

the second side casing is formed in a U shape with two side surfaces and is fitted with the first side casing, wherein the second side casing includes multiple first spaced apertures arranged on a first end of each of the two side surfaces thereof and corresponding to the multiple first spaced orifices, and the second side casing includes multiple second spaced apertures arranged on a second end of each of the two side surfaces thereof and corresponding to the multiple second spaced orifices, and when the second side casing moves away from or close to the first side casing, the multiple first spaced apertures align with the multiple first spaced orifices, and the multiple second spaced apertures align with another of the multiple second spaced orifices;

each of the multiple bottom casings is in a triangle shape and covers a bottom of each of the first side casing and the second side casing, wherein a size of each of said bottom casings corresponds to a length of a combination of bottoms of the first side casing and the second side casing;

each of the multiple top casings is in a triangle shape and covers a top of each of the first side casing and the second side casing, wherein a size of each of said top casings corresponds to a length of a combination of tops of the first side casing and the second side casing;

each of the plurality of binding straps is inserted into the packing box via one of the multiple first spaced apertures and one of the multiple first spaced orifices, and each of said binding straps extends out of the packing box through one of the multiple second spaced orifices and one of the multiple second spaced apertures, thereafter each of said binding straps surrounds one of said bottom casings and is inserted into the packing box via one of said second spaced orifices and one of said second spaced apertures, and each of said binding straps extends outwardly from one of said first spaced orifices through one of said first spaced apertures so as to surround one of said top casings;

wherein each of said binding straps includes a loop arranged on a first end thereof, a second end of the binding strap is provided with a hook-and-loop fastener consisting of a male fastening face and a female fastening face, the second end of the binding strap is passed through the loop and turned around to make the male fastening face fasten with the female fastening face so that each of said binding straps fixes the packing box.

* * * * *